United States Patent [19]

Dougherty

[11] Patent Number: 4,586,736

[45] Date of Patent: May 6, 1986

[54] FLUSH MOUNTING CUP FOR CABINET LATCH

[75] Inventor: Robert W. Dougherty, Media, Pa.

[73] Assignee: Southco, Inc., Concordville, Pa.

[21] Appl. No.: 616,918

[22] Filed: Jun. 4, 1984

[51] Int. Cl.[4] ..... E05C 3/04

[52] U.S. Cl. ..... 292/202

[58] Field of Search ..... 292/101, 202, 241; 411/103, 107, 352, 353, 368, 533, 516–518, 544, 546

[56] References Cited

U.S. PATENT DOCUMENTS 2,470,927 5/1949 Hale ..... 411/353

3,121,453 2/1964 Modrey ..... 411/103

FOREIGN PATENT DOCUMENTS 1271590 6/1968 Fed. Rep. of Germany ..... 292/202

OTHER PUBLICATIONS

American Cabinet Hardware Corp. pamphlet, "Compressor Door Hardware", p. 89, 6/10/1938.

*Primary Examiner*—Kenneth J. Dorner

*Assistant Examiner*—Russell W. Illich

*Attorney, Agent, or Firm*—Paul & Paul

[57] ABSTRACT

A cabinet latch is flush mounted on a cabinet door panel by a flanged conical cup which is inserted into a precut hole in the door panel. A push-on retainer clip presses against the inner surface of the door panel and holds the outward flange of the conical cup against the outer surface of the door panel. The head of the latch pawl shaft is received within the cup. In thin door installations, where the thickness of the door is less than the depth of the conical cup, a second cup is mounted on the pawl shaft on the inside of the door panel and a push-on retainer clip presses against an inward flange of the inner cup to hold both cups against the door panel, the outward flange of the outer cup pressing against the outer surface of the door panel and the outer flange of the inner cup pressing against the inner surface of the door panel.

5 Claims, 5 Drawing Figures

FLUSH MOUNTING CUP FOR CABINET LATCH

BACKGROUND OF THE INVENTION

This invention relates to means for mounting a cabinet latch on a cabinet door panel. Such a latch ordinarily includes, as one component thereof, a pawl shaft having an enlarged head which may be circular in cross section and provided either with a slot or with a non-circular tool-receiving recess. The first type of head is usually referred to as a slotted head; the second type is usually referred to as a toolhead. Alternatively, the enlarged head may be non-circular in cross section. For example, it may be square, or hexagonal, or octagonal. Such a non-circular head is usually referred to as a spanner head.

In most prior art installations, the enlarged head of the pawl shaft projects outwardly from the flat outer surface of the cabinet door panel. To prevent such outward projection, in some prior art installations the panel itself has been dimpled, thereby to provide a recess which receives the head of the shaft. A prior art dimpled panel is illustrated in FIG. 1 of the present application.

SUMMARY OF THE PRESENT INVENTION

A principal object of the present invention is to provide means for mounting a latch on a cabinet door panel which permits the head of the shaft to be essentially flush with the outer surface of the cabinet door panel without dimpling the door panel.

Dimpling the door panel involves expensive tooling and requires an additional manufacturing operation.

The object of providing an essentially flush mounted latch for a cabinet door panel, without dimpling, is accomplished by cutting a circular hole in the panel and inserting into the hole a cup-shaped part (hereinafter referred as a cup) having a sloping sidewall, a radially outwardly extending flange at its larger diameter end, and a radially inwardly extending flange at its smaller diameter end. The inwardly extending flange terminates radially short of the center axis of the cup, forming a circular hole in the inward end of the cup through which the pawl shaft passes.

DETAILED DESCRIPTION OF THE PREFERRED EMBODIMENTS

Figure 1:
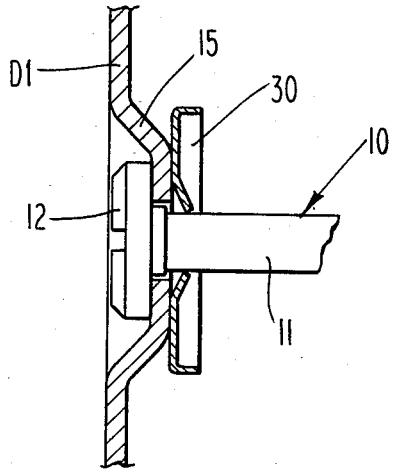
PRIOR ART Fig. 1
FIG. 1 is an illustration showing the dimpled door panel of the prior art.

As already indicated, FIG. 1 is an illustration of a prior art way of mounting a latch on a cabinet door panel without having the enlarged head of the pawl shaft project beyond the outer surface of the panel.

In FIG. 1, shaft 10 having a slotted circular head 12 is inserted into a hole located in a dimple 15 formed in a thin door panel D-1. Shaft 10 is held in place by a push-on retainer clip 30.

Figure 2:
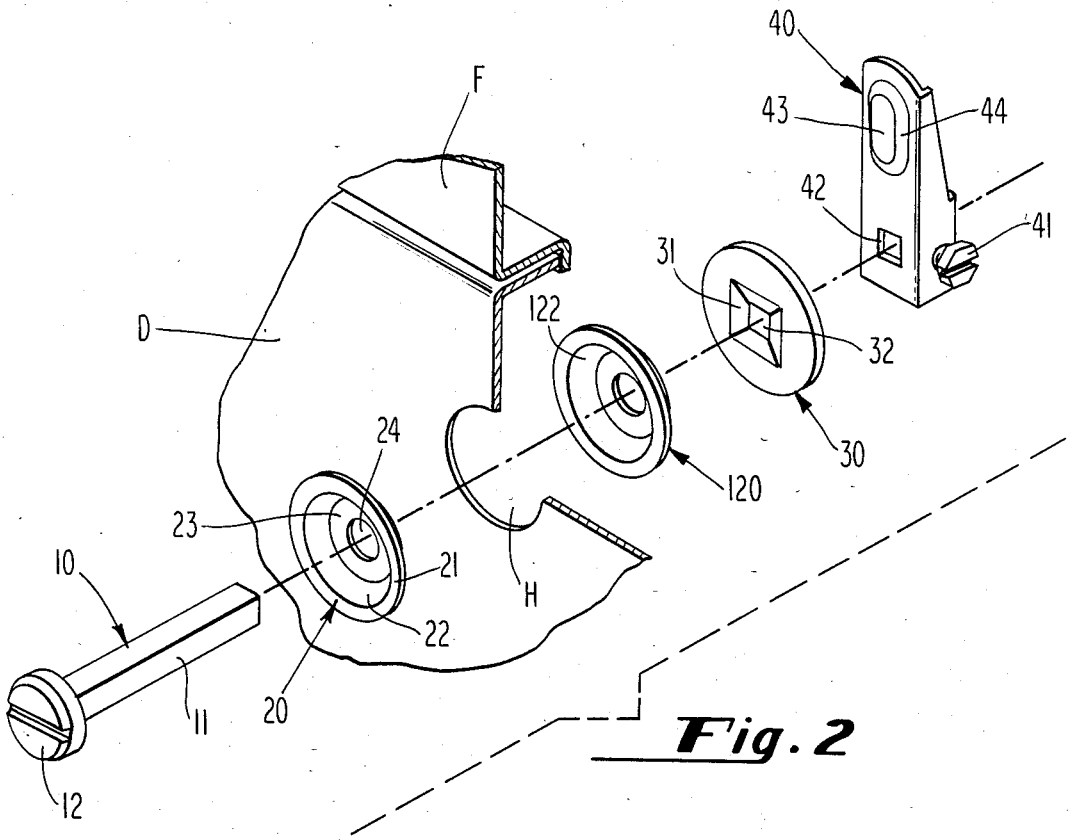
FIG. 2 is an exploded view of the new mounting assembly showing, in order, from left to right, a shaft having a slotted circular head; a first conical cup inserted into a circular hole in a thin door panel for mounting against the outer surface of the thin panel; a second conical cup for mounting against the inside surface of the thin panel; a push-on retainer clip; and a latch pawl.

FIG. 2 illustrates, in an exploded view, the parts which are provided by the present invention. Shaft 10 is illustrated as having a shank 11 of square cross section and an enlarged circular slotted head 12. At the extreme right in FIG. 2 is illustrated one type of latch pawl 40 which may be used. Latch pawl 40 is provided with a square hole 42 through which the square shank 11 of shaft 10 will pass. A set screw 41 is provided for securing the latch pawl 40 to the shaft 10. The upper or outer end of latch pawl 40 is provided with a boss 43 having inclined ramp surfaces 44 on each side so that when the latch pawl 40 is pivoted, the boss 43 will come into engagement with frame F and the pawl will be forced inwardly, thereby pulling the door D into tightly closed position, as illustrated in FIG. 3.

In accordance with the present invention, in lieu of dimpling the door panel as is illustrated in FIG. 1, a circular hole H is cut in the door panel of a size corresponding approximately to the larger diameter of a conical cup 20, which is inserted into hole H before the shaft 10 is pushed through hole H. As illustrated in FIG. 3, cup 20 has a sidewall 22 which slopes inwardly rearwardly. The outward larger-diameter of cup 20 is provided with an outwardly extending radial flange 21. At the inward smaller-diameter end of the cup, an inwardly extending radial flange 23 is provided which terminates short of the center axis of the cup, thus providing a circular hole 24 through which the shank 11 of shaft 10 passes. Shaft 10 and cup 20 are inserted into the hole H in the door panel D until the inner surface of the radial flange 21 abuts against the outer surface of the door panel.

Figure 3:
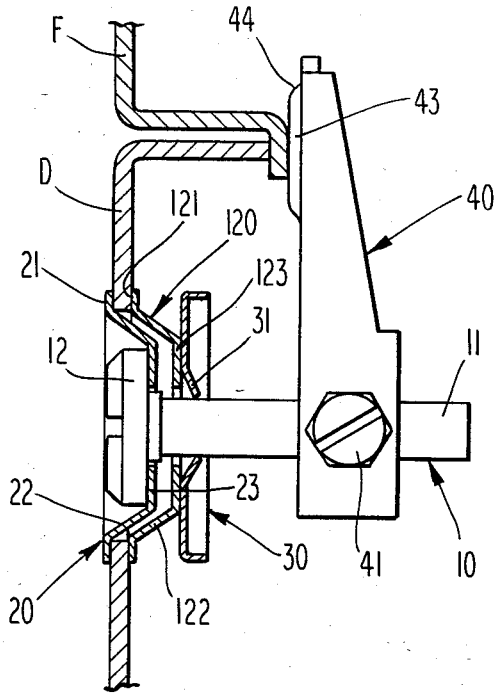
FIG. 3 is a view, partly in section, showing the manner in which in accordance with the present invention, the latch is mounted in a thin door panel.

In thin-panel installations, such as is illustrated in FIG. 3, the depth of cup 20 is greater than the thickness of the door panel. In such cases, a second cup 120, which is identical to the first cup 20, is pushed onto shaft 10 after shaft 10 has been inserted into hole H. Next a push-on retainer clip 30 having a square center hole 32 is pushed on to shaft 10 and pressed against the inward flange 123 of cup 120 until the radial flange 121 of cup 120 abuts against the inner surface of the door panel and the radial flange 21 of the outer cup 20 presses inwardly against the outer surface of the door panel, as illustrated in FIG. 3. Clip 30 is retained in position on shaft 10 by the spring-leaf retaining flaps 31.

Figure 4:
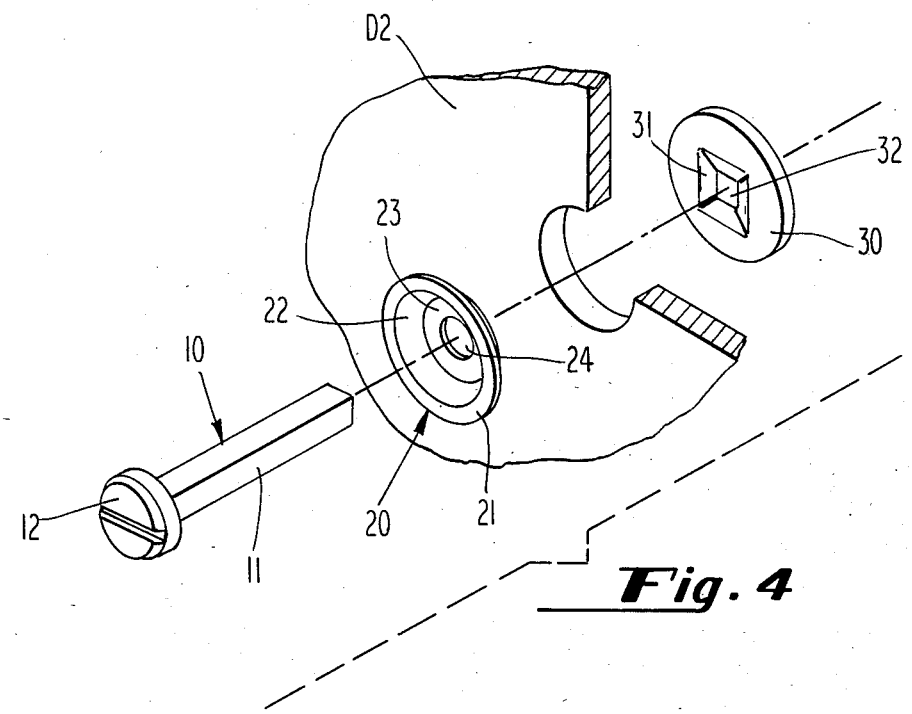
FIG. 4 is an exploded view, generally similar to that of FIG. 2, but showing the means for mounting the latch in a door panel having considerable thickness. In such a thickpanel installation, only a single conical cup is employed.
Figure 5:
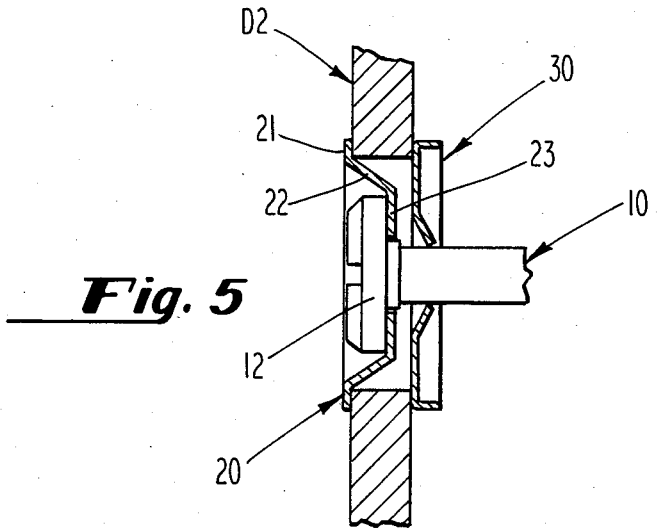
FIG. 5. is a view, in section, showing the manner in which the latch is mounted in a thick panel.

It will be understood that where the depth of cup 20 is greater than the thickness of a thin door panel D two cups 20 and 120 are employed, the second cup 120 being necessary because the retaining clip 30 would not come into engagement with the inner surface of the thin panel D and the radial flange 21 of the cup would not be pulled up against the door, and, hence latch shaft 10 would not be firmly locked in position.

Where the thickness of the door panel is greater than the depth of cup 20 only a single cup is necessary. Such a thick-wall installation is illustrated in FIGS. 4 and 5. As seen in FIG. 5, clip retainer 30 is pushed forwardly on shaft 10 until it comes into engagement with the inner surface of door D-2, thereby pulling flange 21 up against the outer surface of door D-2, thereby locking shaft 10 in position.

What is claimed is:

1. A latch mechanism having a pawl shaft inserted through a hole in a cabinet door panel, said shaft having an enlarged head at its outward end; said mechanism including:

a. a first cup supported on said shaft, said cup having a cross-section corresponding in shape to the shape of the hole in the door panel;

b. said cup having a preselected depth in the axial direction of said shaft;

c. said cup having at its inward end a radially-inward flange terminating short of the center axis of the cup defining a hole in said cup through which said shaft passes;

d. said cup having a radially outward flange at its outward end, the inner dimensions of said outward flange corresponding to the dimensions of said hole;

e. said cup positioned in said hole in said door panel; and f. a retainer clip on said shaft positioned to hold the radially outward flange of said cup tightly against the outward surface of said door panel at the periphery of said hole.

2. A latch mechanism according to claim 1 wherein said hole is circular, the cross-section of said cup is circular, and the radially inward and radially outward flanges of said cup are annular.

3. A latch mechanism according to claim 2 wherein said retainer clip is a one-way push-on type of clip.

4. In a latch mechanism according to claim 3 wherein:

a. the depth of said cup is greater than the thickness of said door panel;

b. the sidewall of said cup slopes inwardly, whereby said cup is conical;

c. a second cup is provided similar in shape and size to said first cup;

d. said second cup is supported on said shaft inwardly of said first cup;

e. said push-on retainer clip is positioned to press outwardly against the radially inward annular flange of said second cup and to press the radially outwardly extending annular flange of said second cup tightly against the inward surface of said door panel at the periphery of said hole.

5. In a latch mechanism according to claim 3 wherein the depth of the first cup is less than the thickness of said door panel and wherein said retainer clip is positioned to press against the inward surface of said door panel at the periphery of said hole.

* * * * *